US006548965B1

(12) United States Patent
Maya et al.

(10) Patent No.: US 6,548,965 B1
(45) Date of Patent: Apr. 15, 2003

(54) ELECTRODELESS FLUORESCENT LAMP WITH LOW WALL LOADING

(75) Inventors: Jakob Maya, Brookline, MA (US); Oleg Popov, Needham, MA (US); Robert Chandler, Lexington, MA (US)

(73) Assignee: Matsushita Electric Works Research and Development Labs Inc., Woburn, MA (US)

( * ) Notice: Subject to any disclaimer, the term of this patent is extended or adjusted under 35 U.S.C. 154(b) by 0 days.

(21) Appl. No.: 09/505,756

(22) Filed: Feb. 16, 2000

(51) Int. Cl.[7] ..... H05B 41/16; H01J 17/04

(52) U.S. Cl. ..... 315/248; 313/628

(58) Field of Search ..... 315/248; 313/628, 313/642, 234, 138, 318.03, 344, 634; H05B 41/16; H01J 17/04

(56) References Cited

U.S. PATENT DOCUMENTS 4,254,363 A * 3/1981 Walsh ..... 315/248
5,013,975 A * 5/1991 Ukegawa et al. ..... 315/248
5,013,976 A * 5/1991 Butler ..... 315/248
5,327,049 A * 7/1994 Smolka et al. ..... 315/248
5,367,226 A * 11/1994 Ukegawa et al. ..... 315/248
5,519,285 A * 5/1996 Ukegawa et al. ..... 315/594
5,723,947 A * 3/1998 Popov et al. ..... 313/634
5,952,792 A * 9/1999 Borowiec et al. ..... 315/248
6,118,226 A * 9/2000 Kohm et al. ..... 315/248

* cited by examiner

*Primary Examiner*—Don Wong
*Assistant Examiner*—Trinh Do Dinh

(57) ABSTRACT

An electrodeless fluorescent lamp employs a glass envelope made from a single linear tube or bulb and a reentry cavity disposed on the envelope axis and sealed to the envelope. The envelope is filled with inert gas and mercury vapor. Phosphor and protective coatings are disposed on the inner surfaces of the envelope and the cavity. An induction coil of A few turns made from silver coated copper wire is wrapped around the envelope in its axial direction. The inductively-coupled axially uniform plasma is generated inside the envelope. The discharge electric field and current form a closed-loop path inside the envelope along its walls. The introduction of the reentry cavity decreases the lamp wall loading without loosing lamp power efficiency and efficacy. The lamp is operated at frequencies from 50 kHz to 200 MHz and RF power from 5 W to 2000 W without the use of ferrite inside of the reentry cavity.

22 Claims, 6 Drawing Sheets

ELECTRODELESS FLUORESCENT LAMP WITH LOW WALL LOADING

FIELD ON THE INVENTION

This invention relates to electric lamps and, more specifically, to fluorescent electrodeless lamps operated at low and intermediate pressures without the use of ferrite at frequencies from 50 kHz to 200 MHz.

BACKGROUND OF THE INVENTION

Electrodeless fluorescent lamps utilizing an inductively coupled plasma were found to have high efficacy and lives that are longer than that of conventional fluorescent laps employing hot filaments and internal electrodes. The plasma that generates UV and visible light is produced in a glass (or quartz) envelope filled with inert gas such as argon, krypton or the like and metal vapor such as mercury, sodium or the like. The induction coil that generates the inductively coupled plasma is positioned in the close proximity of the lamp envelope.

In a co-pending U.S. patent application Ser. No. 09/420,673 by Popov et al. (owned by a common assignee) the envelope is a straight or bent single tube with sealed both ends. The induction coil is wound along the tube surface in its axial direction forming several turns (windings) that are parallel to each other and to the tube's axis thereby generating the axially uniform plasma along the tube walls. The inner walls of the envelope are coated with phosphor and protective coatings. The UV light is absorbed in the phosphor and then converted to visible light uniformly throughout the envelope surface. The efficacy of such a lamp at a frequency of 0.4–15 MHz and RF power of 50–150 W is high, 80–100 LPW, and dependent on lamp power efficiency and phosphor composition.

The plasma is kept axially uniform at lamp dimming down to 20% of the maximum light output that makes the lamp useful at such applications as tunnel lighting and general street lighting. However, in some applications where there are restrictions on bulb size, the use of high RF power, needed for high lumen output, leads to high bulb wall loading (wall surface power density, P/S) exceeding the loading of 200 mW/cm$^2$. The excessive wall loading (higher than 200 mW/cm$^2$) causes phosphor damage and eventually leads to phosphor coating degradation and hence, short lamp life.

For instance, the lamp with the tube of 50 mm in diameter and 300 mm in length, and operated at RF power of 150 W, has the wall loading of 318 mW/cm$^2$. This value is substantially higher (60%) than the generally accepted maximum wall loading of 200 mW/cm$^2$. To reduce wall loading one has to increase the tube surface area or increase the lamp efficacy. However, in many applications, the bulb diameter and length can not be increased due to limitations imposed by the size of the lamp fixture.

As to the lamp efficacy, the substantial increase of the lamp efficacy (by 20–30%) can be achieved by using phosphor producing "greenish" light. However, in most outdoor and indoor applications lamps with "greenish" light are not acceptable.

We found out a new method to decrease substantially the wall loading of the lamp described in the Popov et al patent application without the increase of bulb diameter and length and without sacrificing lamp efficacy. We achieved this by the introduction of a reentrant cavity along the bulb axis that increases substantially the bulb surface area exposed to the discharge plasma and thereby reduces the wall loading, in conjunction with the use of an outer coil and no ferrite.

SUMMARY OF THE INVENTION

According to the present invention, a novel approach is disclosed that results in an efficient ferrite-free electrodeless lamp that is operated at a frequency from 50 kHz to 200 MHz with the wall loading below 200 mW/cm$^2$. The lamp power efficiency and efficacy were found to be comparable to those of electrodeless fluorescent lamp disclosed in the Popov et al patent application mentioned above. The present invention comprises an electrodeless fluorescent lamp having a glass envelope made from a straight single tube or bulb of any cross section and size. A reentrant cavity is disposed along the tube axis and sealed to the one of the end of the envelope. A filling of inert gas and vaporous metals such as mercury or cadmium and sodium are placed in the envelope. The metal vapor pressure is maintained below 5 Torr, and inert gas pressure is below 20 Torr. A protective coating is disposed on the inner surface of the envelope and reentrant cavity walls and a phosphor coating is disposed on the protective coating. The reflective coating is disposed on the inner (vacuum) walls of the reentry cavity, between the phosphor and protective coatings thereby reflects visible light from the cavity and reduces light "trapped" inside the cavity. The reflection effect is increased when the outer surface of the cavity walls is also coated with the reflective coating (alumina).

An induction coil formed from the plurality of windings (turns) is disposed on the outer surface of the envelope along its axial direction. All turns are parallel to each other and to the tube's axis. The radio-frequency (RF) power source coupled to the induction coil generates an RF voltage across the coil that ignites and maintains an RF inductively coupled discharge inside the tube along its walls. The discharge forms a "closed-loop" path inside the tube along its walls that is necessary condition to maintain an inductively coupled discharge in the tube.

The power absorbed by the plasma is partially "transformed" into the power "deposited" by the plasma ions and UV photons in the phosphor coatings on the inner walls of the envelope and the reentrant cavity.

An object of the present invention is to design an efficient ferrite-free electrodeless fluorescent lamp operated in a wide range of frequencies, from 50 kHz to 200 MHz and wide range of power, from 5 W to 2000 W.

Another object of the present invention is to design an envelope that has a reentrant cavity that results in the reduction of the envelope wall loading without the increase of the outer envelope dimensions.

Yet another object of the present invention is to design an induction coil that consumes insignificant amount of RF power in kHz and MHz ranges, so the efficiency of the lamp is the same or comparable to that of a lamp described in the Popov et al application.

Again, another object of the present invention is to locate the coil in such a manner as to provide its efficient coupling with the lamp plasma.

Another object of the present invention is to provide a compact fluorescent lamp operating at kHz and MHz ranges of frequencies, without the use of ferrite and having long life.

A further object of the present invention is to generate axially uniform plasma that generates axially uniform visible light when operated at any power including that of dimming conditions.

The many other objects, features and advantages of the present invention will become apparent to those skilled in the art upon reading the following specifications when taken in conjunction with the drawings and claims.

DESCRIPTION OF THE PREFERRED EMBODIMENTS

Figure 1A:
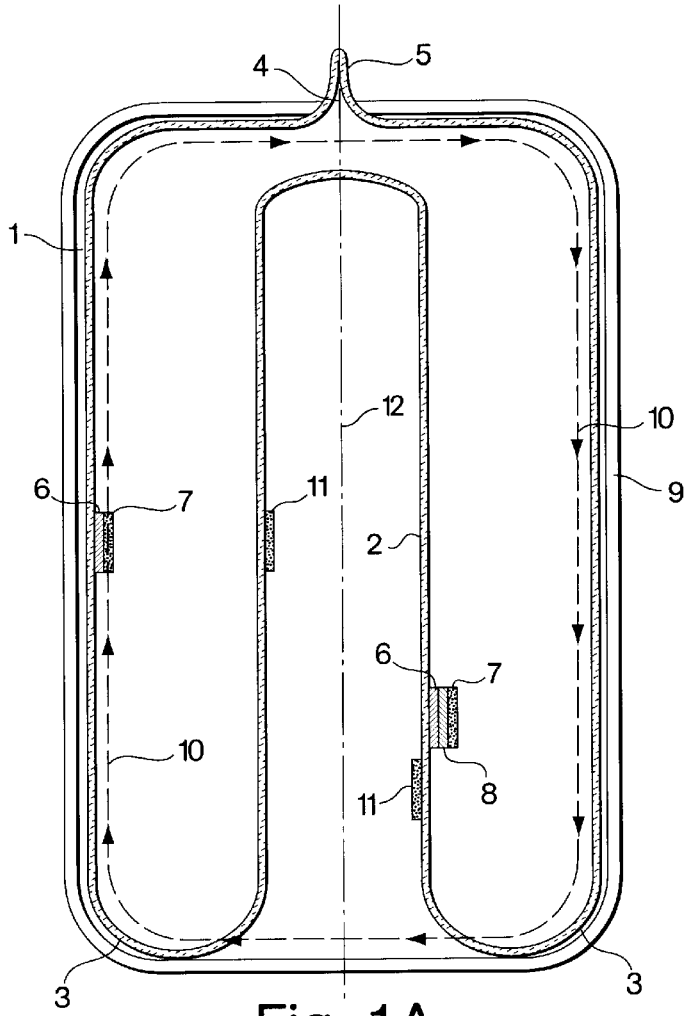
FIG. 1*a* is a cross sectional elevational view of the first embodiment of the present invention.
Figure 1B:
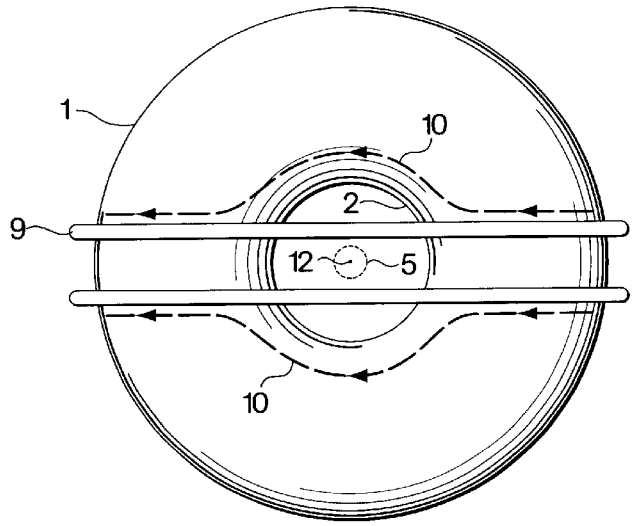
FIG. 1*b* is a view of the bottom of the embodiment shown in FIG. 1*a*.

Referring to FIG. 1 a lamp envelope 1 is a straight tube made from glass. The cavity 2 is disposed on the envelope 1 axis and sealed to one end 3 of the envelope 1. The metal (mercury) vapor pressure in the envelope is maintained by the temperature of the amalgam (or mercury drop) 4 located in the exhaust tubulation 5.

Protective coating 6 and phosphor coating 7 are disposed on the inner surface of the envelope 1. The reflective coating 8 made from alumina or the like are coated on the inner (vacuum) surface of the cavity 2.

An induction coil 9 is disposed on the outer surface of the envelope 1 along its walls providing the continuity of an RF discharge current in the envelope forming the closed-loop path 10. The turns are parallel to each other and lie in planes that are parallel to the envelope's axis of symmetry. The number of turns could be from 1 to 50. In the preferred embodiment, when the lamp was operated at a frequency from 8 MHz to 14 MHz, the coil 9 has 2 turns. The coil was made from copper wire of gauge #14 coated with thin silver coating. A thin Teflon coating is used for electrical insulation and to reflect visible light from the coil 9. To reduce visible light losses inside the cavity, the outer surface of the cavity is coated with the thick reflective coating 11 (alumina or the like).

When the lamp was operated at a lower frequency, f=200–1000 kHz, the coil 9 was made from multiple strand wire (Litz wire) having from 60 to 400 strands each of gauge #40. The number of turns (windings) was from 10 to 20.

Figure 2A:
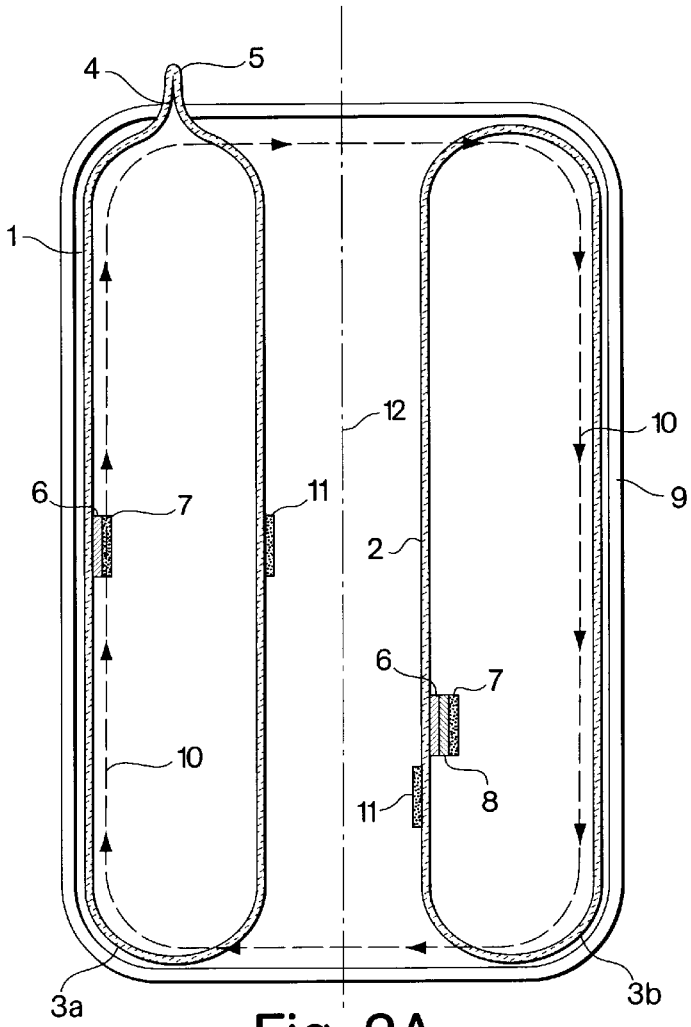
FIG. 2*a* is a cross sectional elevational view of the second embodiment of the present invention.
Figure 2B:
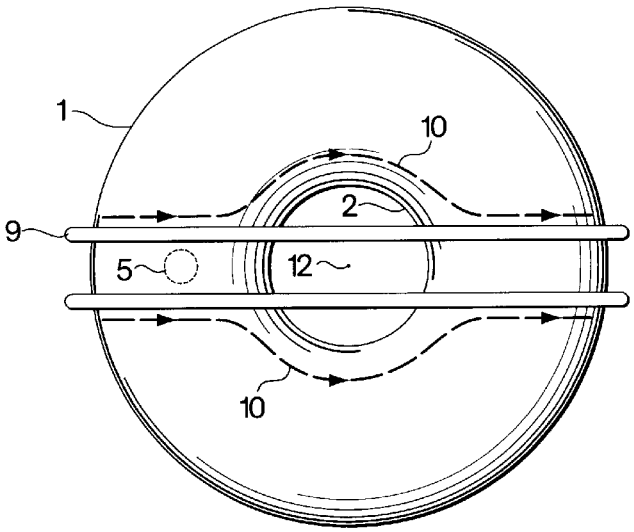
FIG. 2*b* is a view of the bottom of the embodiment shown in FIG. 2*a*.
Figure 3A:
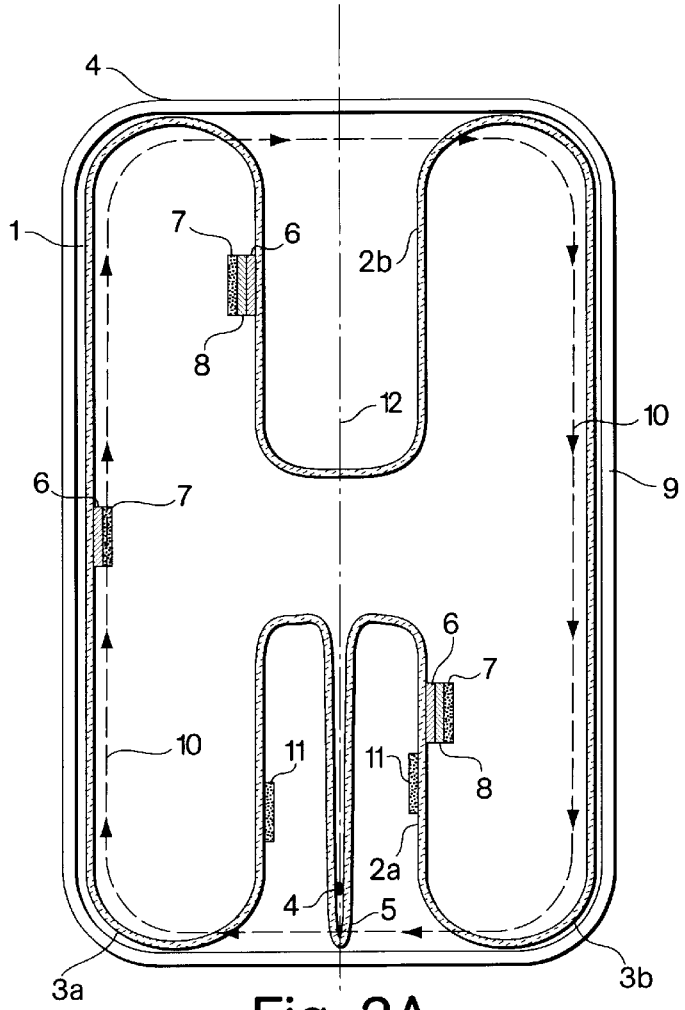
FIG. 3*a* is a cross sectional elevational view of the third embodiment of the present invention.
Figure 3B:
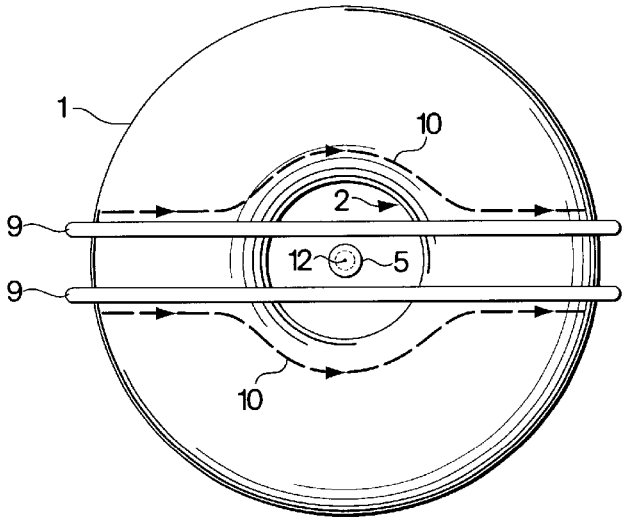
FIG. 3*b* is a view of the bottom of the embodiment shown in FIG. 3*a*.

The second embodiment is shown in FIG. 2. The cavity 2 is sealed to the envelope 1 at two ends, 3*a,* and 3*b* thereby forming a hollow cylinder along the envelope axis. The third embodiment is shown in FIG. 3. The lamp has two cavities, 2*a* and 2*b*. Each cavity is sealed to the envelope 1 at ends 3*a* and 3*b,* respectively. All turns lie in planes that are parallel to the bulb axis of symmetry 12.

Figure 4:
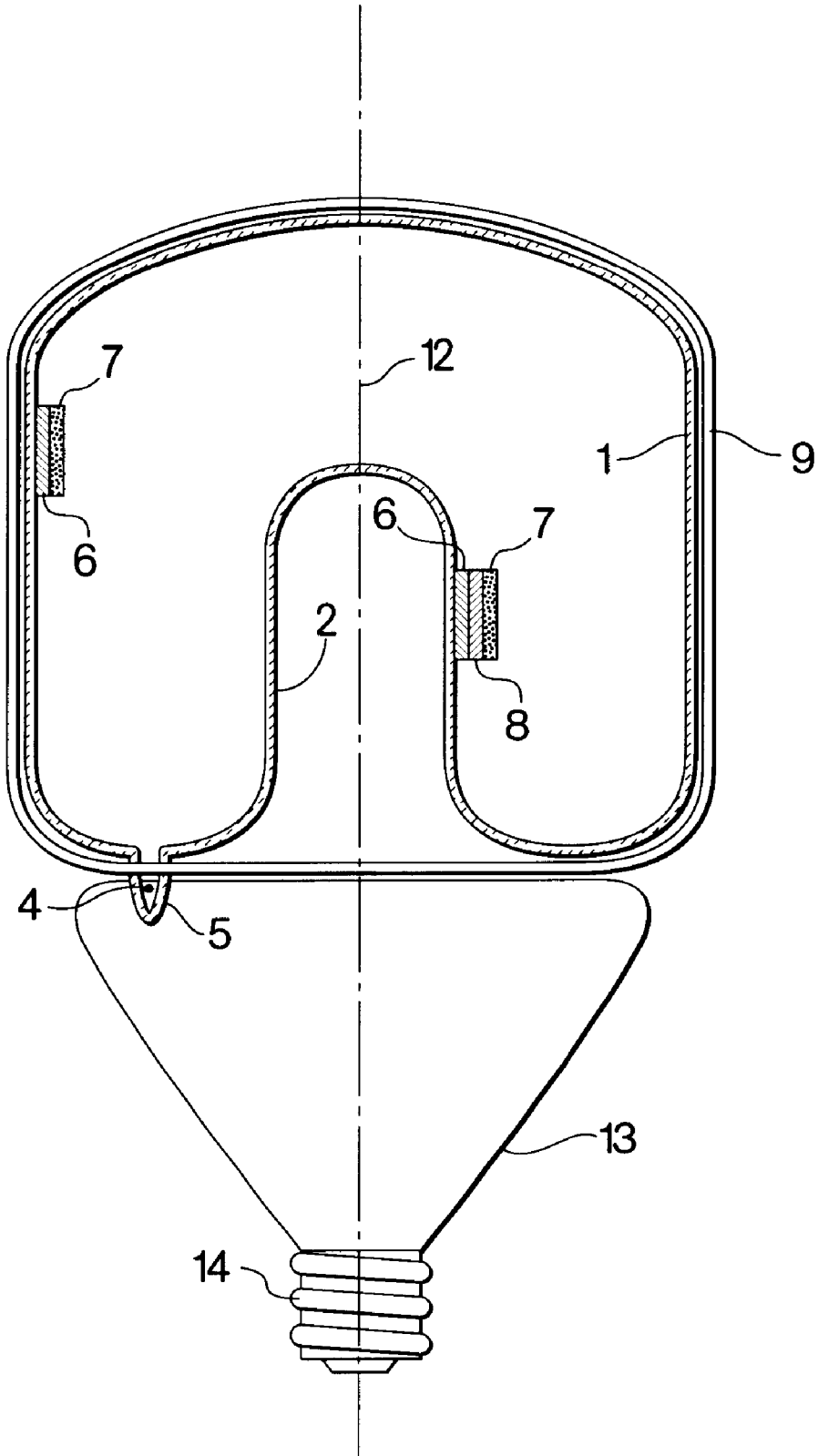
FIG. 4 is an elevational view of the fourth embodiment of the present invention as applied to a compact fluorescent lamp.

The fourth embodiment is shown in FIG. 4. It presents an integral compact fluorescent lamp. The lamp has a bulb 1 that has spherical, cylindrical, A-type, or R-type shape, and a reentry cavity 2 that is disposed on the bulb axis. The induction coil 9 is wrapped around the bulb 1 in the vertical plane. The mercury pressure in the bulb is maintained by the temperature of the mercury drop 4 condensed in the cold spot in the tubulation 5. The lamp driver that includes a matching network is disposed in the enclosure 13 that is attached to the Edison cup 14. In the fifth embodiment of the present invention, coil 9 is formed of two layers thereby reducing the envelope surface "covered" with the coil.

Figure 7A:
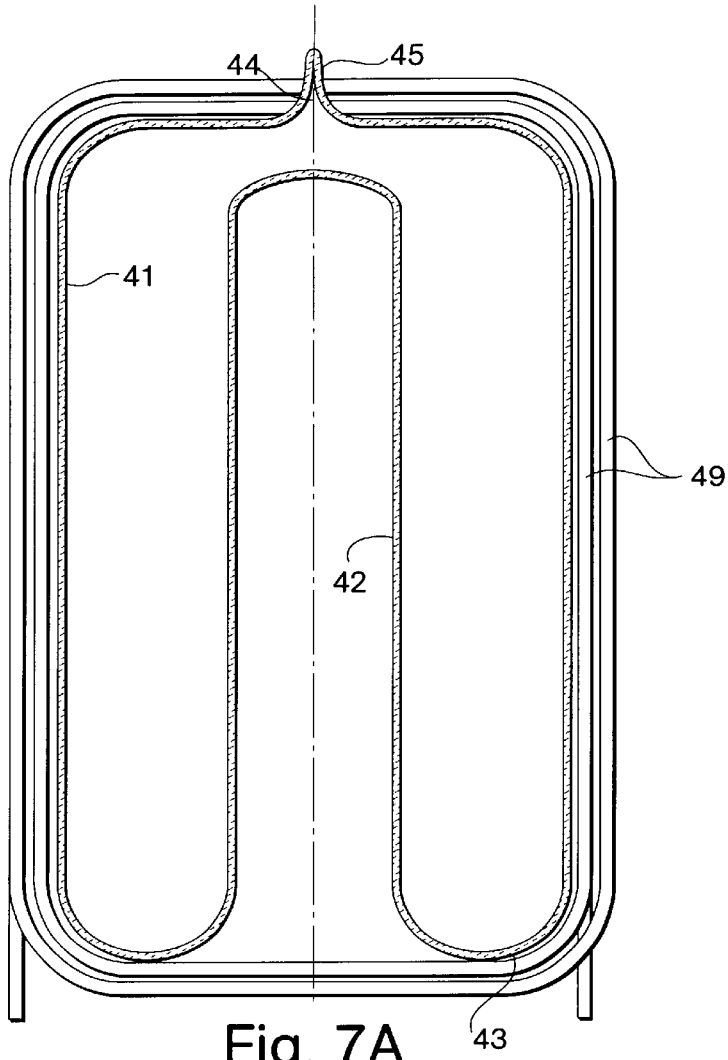
FIG. 7*a* is an elevational side view, partially in cross section, showing the lamp with several layers of windings on it.
Figure 7B:
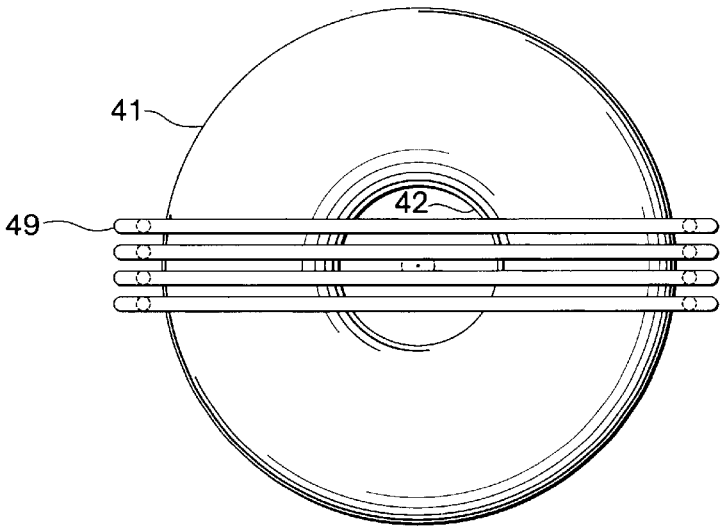
FIG. 7*b* is a top view of the lamp illustrated in FIG. 7*a*.

Referring to FIGS. 7*a* and 7*b,* as in FIG. 1, a lamp envelope 41 is a straight tube made from glass. The cavity 42 is disposed on the envelope axis and sealed to one end 43 of the envelope 41. The metal (mercury) vapor pressure in the envelope is maintained by the temperature of the amalgam (or mercury drop) 44 located in the exhaust tubulation 45. The phosphor and other coatings are the same as described in the description of FIG. 1. An induction coil 49 formed of at least two layers of windings is disposed on the outer surface of the envelope 41 along its walls providing the continuity of an RF discharge current in the envelope forming the closed-loop path 10. The turns are parallel to each other and lie in planes that are parallel to the envelope's axis of symmetry. The number of turns can be from 1 to 50. In the preferred embodiment, when the lamp was operated at a frequency from 8 MHz to 14 MHz, the coil 9 has 2 turns. The coil was made from copper wire of gauge #14 coated with thin silver coating. A thin Teflon coating is used for electrical insulation and to reflect visible light from the coil 49. To reduce visible light losses inside the cavity, the outer surface of the cavity is coated with the thick reflective coating 41 (alumina or the like).

Referring to FIGS. 1 and 7, the lamp is operated as follows: The RF voltage is applied to the coil 9 from an RF driver and a conventional matching network (not shown) located in the fixture or not far from the lamp. When the RF voltage reaches a couple of hundred volts, a capacitive discharge with a weak plasma is ignited inside the envelope 1. When the inductively-coupled RF voltage, induced along the path 10, $V_{p1}$, reaches a certain "starting" value, $V_{st}$, a bright and axially uniform plasma appears in the envelope. The light output is determined by the lamp power efficiency, that is the ratio of the RF power absorbed by the plasma, $P_{p1}$, to the total lamp power, $P_{lamp}$. RF power that is not absorbed by the plasma is lost in the coil 9.

Below we present electrical and photometric data measured in the lamp according to the first embodiment and shown in FIG. 1. The tube has the diameter of 60 mm and the length of 290 mm. The cavity diameter was 20 mm and the length was 275 mm. The total lamp inner surface area exposed to the plasma was 720 $cm^2$, that is higher than the area of the tube's outer surface (546 $cm^2$). The mercury vapor pressure was maintained by the temperature of the mercury drop 4 that was condensed in the cold spot in the tubulation 5. The argon pressure was 100 mTorr.

Figure 5:
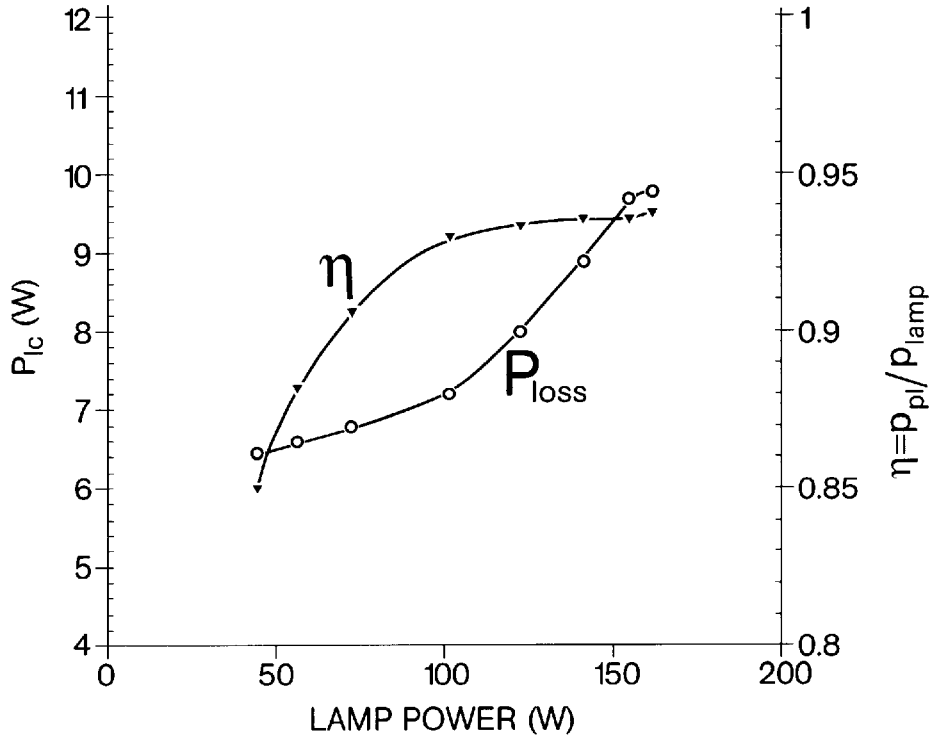
FIG. 5 is the graph showing the coil power losses, Ploss, and the lamp power efficiency, $\eta=P_{pi}/P_{lamp}$, as functions of the total lamp power, $P_{lamp}$. The lamp is shown as in FIG. 1 (the first embodiment). The bulb diameter is 60 mm, the cavity diameter is 20 mm, and the lamp length is 290 mm. The coil is made from copper wire of gauge #14; it has two windings with the inductance, L=2.3 ηH. Argon pressure is 100 mTorr; The driving frequency is 9.5 MHz.

The coil power losses, $P_{loss}$, and the lamp power efficiency, $\eta=P_{p1}/P_{lamp}=(P_{lamp}-P_{loss})/P_{lamp}$ are shown in FIG. 5 as functions of lamp power, $P_{lamp}$ for the lamp operated at a frequency of 9.5 MHz. It is seen that the power losses, $P_{loss}$, grows with the lamp power from 6.5 W at $P_{lamp}$=45 W, to 10 W at $P_{lamp}$=165 W.

The lamp power efficiency, $\eta$, rapidly increases at low power, $P_{lamp}$<100 W. At P>100 W, the power efficiency stops increasing and has a value of 0.936. This value is very close to that (0.93) measured in the "cavity-free" straight tube lamp of 50 mm in diameter that was described in the above mentioned Popov et al patent application.

Figure 6:
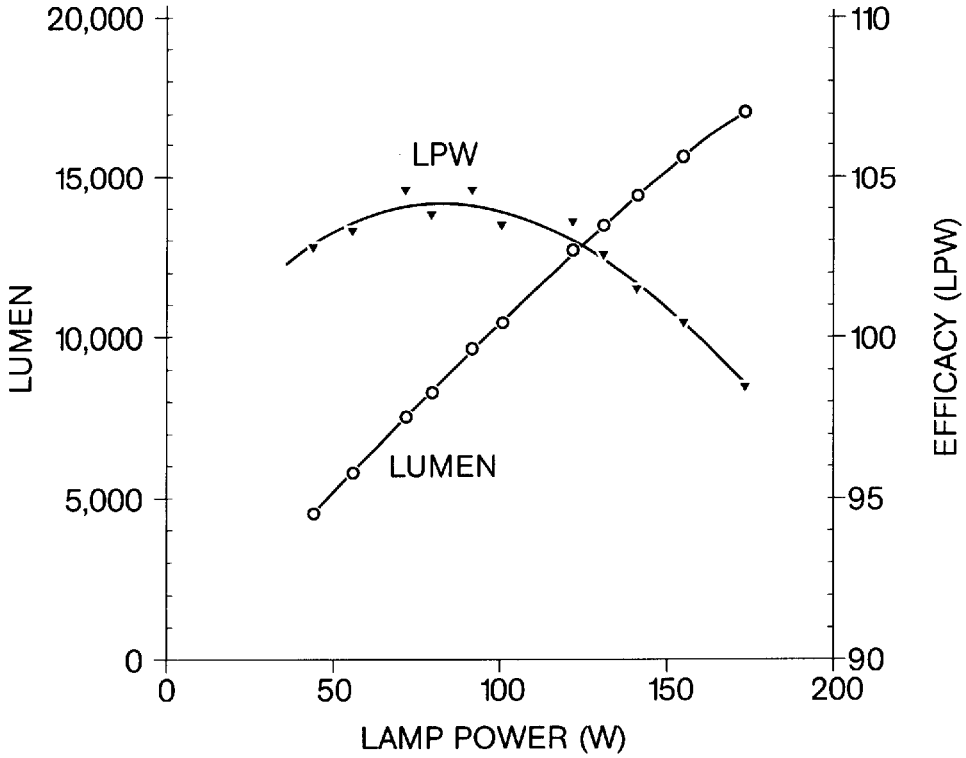
FIG. 6 is the graph showing the lamp light output (Lm) and lamp efficacy (LPW) as functions of the lamp power, $P_{lamp}$, for the driving frequency of 9.5 MHz. The key and legend as in FIG. 5.

Such a high power efficiency, $\eta$=0.93, results in high lamp efficacy at lamp power around 100 W. The lamp light output and efficacy for the same lamp with the "greenish" phosphor coating (65% of LAP and 35% of YOX) are shown in FIG. 6. It is seen that light output increases monotonically with $P_{lamp}$ from 40 to 175 W, while the lamp efficacy has maximum of 104 LPW at $P_{lamp}$=70–90 W. Note that the power wall loading, $P_{p1}/S$, in the lamp described in the present invention is substantially lower than that in the Popov et al application. At very high RF power of 160 W ($P_{p1}$=150 W), the wall loading of the lamp described in the present invention is 200 mW/cm$^2$. While in the lamp of the same bulb diameter but without reentry cavity, the wall loading at the same power of 160 W ($P_{p1}$=150 W) was 275 mW/cm$^2$. Due to low wall loading, the lamp described in the present invention is expected to have less phosphor deterioration by the ion and photon bombardment and therefore a longer life.

It is apparent that modifications and changes can be made within the spirit and scope of the present invention, but it is our intention, however, to be limited only by the scope of the appended claims.

As our invention, we claim:

1. An electrodeless fluorescent lamp comprising:

a glass lamp envelope made from a single straight tube, said envelope having an outer surface and an axis of symmetry;

at least one reentrant cavity disposed within said envelope and aligned with said axis of symmetry, said cavity being sealed to said envelope;

a filling of inert gas and at least one vaporous metal selected from the group consisting of mercury, cadmium, sodium the vapor pressure of said metal being below 10 mTorr during operation;

a protective coating disposed on the inner surface of said envelope and said cavity;

a phosphor coating disposed on said protective coating;

a reflective coating disposed on inner surface of said cavity between said protective coating and said phosphor coating;

an inductive coil formed of a plurality of windings disposed on said outer surface of said envelope, said windings being wrapped around said envelope in a direction that is parallel to said axis of symmetry, thereby forming the closed-loop discharge inside said envelope, a radio-frequency (RF) power source coupled to said coil to ignite and maintain RF discharge in said envelope to generate a plasma.

2. The electrodeless fluorescent lamp as defined in claim 1 wherein said reentrant cavity has one end, said end being disposed on said axis of said envelope, said cavity being sealed with its one end to the corresponding end of said envelope.

3. The electrodeless fluorescent lamp as defined in claim 1 wherein said cavity has two ends, said ends being disposed around said axis of said envelope, said cavity being sealed with its two ends sealed to two corresponding ends of said envelope thereby forming a hollow cylinder.

4. The electrodeless fluorescent lamp as defined in claim 1 wherein there are two cavities disposed on the axis of said envelope, each of said cavities being sealed with one end to the corresponding end of said envelope.

5. The electrodeless fluorescent lamp as defined in claim 1 wherein the envelope is of a bulbous shape of diameter from 2 cm to 50 cm.

6. The electrodeless fluorescent lamp as defined in claim 1 wherein said tubular envelope has a length from 5 cm to 200 cm.

7. The electrodeless fluorescent lamp as defined in claim 1 wherein said tubular envelope has a diameter from 2 cm to 30 cm.

8. The electrodeless fluorescent lamp as defined in claim 2 wherein said cavity has length from 1 cm to 199 cm.

9. The electrodeless fluorescent lamp as defined in claim 4 wherein said cavities have equal and different length from 0.5 cm to 199 cm.

10. The electrodeless fluorescent lamp as defined in claim 2 wherein said cavities have diameter from 0.5 cm to 48 cm.

11. The electrodeless fluorescent lamp as defined in claim 1 wherein said induction coil is made from copper wire of gauge from #10 to #26.

12. The electrodeless fluorescent lamp as defined in claim 11 wherein said copper wire is coated with silver.

13. The electrodeless fluorescent lamp as defined in claim 11 wherein said copper wire has Teflon insulation.

14. The electrodeless fluorescent lamp as defined in claim 1 wherein said coil is made form Litz wire, said Litz wire consists of copper strands of gauge from #36 to #44.

15. The electrodeless fluorescent lamp as defined in claim 13 wherein said Litz wire has 20–600 strands.

16. The electrodeless fluorescent lamp as defined in claim 14 wherein said Litz wire is painted with white color.

17. The electrodeless fluorescent lamp as defined in claim 1 said coil has from 1 to 30 windings.

18. The electrodeless fluorescent lamp as defined in claims 17 wherein the pitch between said windings is from close to zero to 50 mm.

19. The electrodeless fluorescent lamp as defined in claim 1 wherein said coil has two layers of turns and said coil is wound so RF currents in adjacent turns of said layers flow in the same direction.

20. The electrodeless fluorescent lamp as defined in claim 1 wherein said coil has three layers of turns and said coil is wound so currents in adjacent layers flow in the same direction.

21. The electrodeless fluorescent lamp as defined in claim 1 wherein said RF power source is at a frequency from 50 kHz to 200 MHz.

22. The electrodeless fluorescent lamp as defined in claim 1 wherein said RF power source is from 5 W to 2000 W.

* * * * *